US009022001B2

(12) United States Patent
Shafto

(10) Patent No.: US 9,022,001 B2
(45) Date of Patent: May 5, 2015

(54) STARTER CONTROL SYSTEMS AND METHODS FOR ENGINE ROCKBACK

(75) Inventor: Robert Douglas Shafto, New Hudson, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 926 days.

(21) Appl. No.: 13/078,334

(22) Filed: Apr. 1, 2011

(65) Prior Publication Data

US 2012/0192826 A1 Aug. 2, 2012

Related U.S. Application Data

(60) Provisional application No. 61/438,345, filed on Feb. 1, 2011.

(51) Int. Cl.
*F02N 11/08* (2006.01)
*F02N 11/10* (2006.01)

(52) U.S. Cl.
CPC ..... *F02N 11/106* (2013.01); *F02N 11/0814* (2013.01); *F02D 2250/06* (2013.01); *F02N 2250/04* (2013.01)

(58) Field of Classification Search
CPC ... F02D 2250/06; F02D 41/062; F02N 11/08; F02N 11/10
USPC ..... 123/179.3, 406.58; 324/392; 701/113; 73/114.26
See application file for complete search history.

(56) References Cited

U.S. PATENT DOCUMENTS

| | | | |
|---|---|---|---|
| 4,492,195 | A | 1/1985 | Takahashi et al. |
| 4,958,516 | A | 9/1990 | Stiles et al. |
| 5,690,073 | A | 11/1997 | Fuwa |
| 5,803,040 | A | 9/1998 | Biesinger et al. |
| 6,155,242 | A | 12/2000 | Kotwicki et al. |
| 6,202,776 | B1 | 3/2001 | Masberg et al. |
| 6,257,207 | B1 | 7/2001 | Inui et al. |
| 6,275,759 | B1 | 8/2001 | Nakajima et al. |
| 6,513,489 | B2 | 2/2003 | Osanai |
| 6,675,088 | B2 | 1/2004 | Miki |
| 6,675,768 | B2 | 1/2004 | Kanai |
| 6,758,190 | B2 | 7/2004 | Denz et al. |
| 6,857,987 | B2 | 2/2005 | Aldrich, III et al. |

(Continued)

FOREIGN PATENT DOCUMENTS

| | | | |
|---|---|---|---|
| CN | 1407221 | A | 4/2003 |
| CN | 1875186 | A | 12/2006 |

(Continued)

OTHER PUBLICATIONS

U.S. Appl. No. 14/559,003, filed Dec. 3, 2014, Shafto et al.

(Continued)

*Primary Examiner* — Mahmoud Gimie
*Assistant Examiner* — David Hamaoui

(57) ABSTRACT

A system for a vehicle, includes a rockback detection module and a starter disabling module. The rockback detection module receives a crankshaft position signal from a bi-directional crankshaft sensor and selectively indicates that a crankshaft of an engine is rotating in a first direction based on the crankshaft position signal. The engine rotates in a second direction that is opposite to the first direction when the engine is running. The starter disabling module disables current to a starter motor when the crankshaft is rotating in the first direction.

21 Claims, 3 Drawing Sheets

(56) References Cited

U.S. PATENT DOCUMENTS

| | | | | |
|---|---|---|---|---|
| 6,931,318 | B2 | 8/2005 | Kaita et al. | |
| 6,987,373 | B2 * | 1/2006 | Kagami et al. | 318/471 |
| 7,079,935 | B2 | 7/2006 | Lewis et al. | |
| 7,079,941 | B2 | 7/2006 | Tetsuno et al. | |
| 7,082,930 | B2 | 8/2006 | Liller et al. | |
| 7,130,731 | B2 | 10/2006 | Itoh et al. | |
| 7,146,960 | B2 | 12/2006 | Phlips et al. | |
| 7,159,571 | B2 * | 1/2007 | Kassner | 123/479 |
| 7,177,755 | B2 | 2/2007 | Nishikawa et al. | |
| 7,204,226 | B2 | 4/2007 | Zillmer et al. | |
| 7,275,509 | B2 * | 10/2007 | Kassner | 123/179.25 |
| 7,331,320 | B2 * | 2/2008 | Asada | 123/179.24 |
| 7,559,304 | B2 | 7/2009 | Kataoka et al. | |
| 7,587,270 | B2 | 9/2009 | Tabata et al. | |
| 7,614,377 | B2 * | 11/2009 | Noguchi | 123/179.3 |
| 7,681,545 | B2 * | 3/2010 | Taki et al. | 123/179.3 |
| 7,931,002 | B1 | 4/2011 | Gibson et al. | |
| 8,099,203 | B2 | 1/2012 | Miller et al. | |
| 8,140,247 | B2 | 3/2012 | Gibson et al. | |
| 8,141,533 | B2 | 3/2012 | Demura | |
| 8,157,035 | B2 | 4/2012 | Whitney et al. | |
| 8,214,112 | B2 | 7/2012 | Rew et al. | |
| 8,408,176 | B2 | 4/2013 | Pursifull et al. | |
| 8,442,747 | B2 | 5/2013 | Ma et al. | |
| 8,543,318 | B2 | 9/2013 | Ma et al. | |
| 8,635,987 | B2 | 1/2014 | Ma et al. | |
| 8,855,896 | B2 | 10/2014 | Ma et al. | |
| 8,892,339 | B2 | 11/2014 | Ma et al. | |
| 2004/0000281 | A1 * | 1/2004 | Wakitani et al. | 123/179.3 |
| 2004/0084002 | A1 | 5/2004 | Mitsutani et al. | |
| 2004/0153236 | A1 | 8/2004 | Itoh et al. | |
| 2006/0048734 | A1 | 3/2006 | Kataoka et al. | |
| 2006/0218923 | A1 | 10/2006 | Sopko et al. | |
| 2007/0084429 | A1 * | 4/2007 | Taki et al. | 123/179.4 |
| 2007/0163531 | A1 | 7/2007 | Lewis et al. | |
| 2007/0261668 | A1 | 11/2007 | Kataoka et al. | |
| 2008/0275624 | A1 | 11/2008 | Snyder | |
| 2009/0066337 | A1 | 3/2009 | Gibson et al. | |
| 2009/0299586 | A1 | 12/2009 | Miller et al. | |
| 2010/0038158 | A1 | 2/2010 | Whitney et al. | |
| 2010/0114462 | A1 | 5/2010 | Gibson et al. | |
| 2010/0174473 | A1 | 7/2010 | Pursifull et al. | |
| 2010/0211299 | A1 | 8/2010 | Lewis et al. | |
| 2011/0146609 | A1 * | 6/2011 | Enoki | 123/179.3 |
| 2011/0295489 | A1 | 12/2011 | Ma et al. | |
| 2012/0192826 | A1 | 8/2012 | Shafto | |
| 2012/0245831 | A1 | 9/2012 | Patterson et al. | |
| 2013/0066540 | A1 | 3/2013 | Lewis et al. | |
| 2013/0304362 | A1 | 11/2013 | Santoso et al. | |
| 2014/0129117 | A1 | 5/2014 | Santoso et al. | |

FOREIGN PATENT DOCUMENTS

| | | | |
|---|---|---|---|
| CN | 1912370 | A | 2/2007 |
| CN | 101598214 | A | 12/2009 |
| CN | 101680414 | A | 3/2010 |
| DE | 102005049092 | A1 | 4/2007 |
| JP | 02081939 | A | 3/1990 |

OTHER PUBLICATIONS

Ohata et al., "Benchmark Problem for Automotive Engine Control", SICE Annual Conference, Sep. 2007, pp. 1723-1726.

Rokusho et al., "Combined Feedforward and Feedback Control for Start-Up Engine Control", 27th Chinese Control Conference, Jul. 2008, pp. 562-565.

Zhang et al., "Model-Based Cold-Start Speed Control Design for SI Engines", Proceedings of the 17th World Congress of the International Federation of Automatic Control, Jul. 2008, pp. 1042-1047.

Saerens et al., "Minimization of the Fuel Consumption of a Gasoline Engine Using Dynamic Optimization", Applied Energy, vol. 86 Iss. 9, Sep. 2009, pp. 1582-1588.

Rajamani, "Vehicle Dynamics and Control", 2006, pp. 111-117.

* cited by examiner

STARTER CONTROL SYSTEMS AND METHODS FOR ENGINE ROCKBACK

CROSS-REFERENCE TO RELATED APPLICATIONS

This application claims the benefit of U.S. Provisional Application No. 61/438,345, filed on Feb. 1, 2011. The disclosure of the above application is incorporated herein by reference in its entirety.

FIELD

The present application relates to internal combustion engines and more particularly to vehicle starter control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An engine combusts an air/fuel mixture to generate drive torque for a vehicle. The air is drawn into the engine through a throttle valve and an intake manifold. The fuel is provided by one or more fuel injectors. The air/fuel mixture is combusted within one or more cylinders of the engine. Combustion of the air/fuel mixture may be initiated by, for example, injection of the fuel and/or spark provided by a spark plug. Combustion of the air/fuel mixture produces exhaust gas. The exhaust gas is expelled from the cylinders to an exhaust system.

An engine control module (ECM) controls the torque output of the engine. For example only, the ECM controls the torque output of the engine based on driver inputs and/or other inputs. The driver inputs may include, for example, an accelerator pedal position, a brake pedal position, inputs to a cruise control system, and/or other driver inputs. The other inputs may include inputs from various vehicle systems, such as a transmission control system.

A vehicle may include an auto-start/stop system that increases the vehicle's fuel efficiency. The auto-start/stop system increases fuel efficiency by selectively shutting down the engine while the vehicle is running. While the engine is shut down, the auto-stop/start system selectively starts up the engine when one or more start-up conditions are satisfied.

SUMMARY

A system for a vehicle, includes a rockback detection module and a starter disabling module. The rockback detection module receives a crankshaft position signal from a bi-directional crankshaft sensor and selectively indicates that a crankshaft of an engine is rotating in a first direction based on the crankshaft position signal. The engine rotates in a second direction that is opposite to the first direction when the engine is running. The starter disabling module disables current to a starter motor when the crankshaft is rotating in the first direction.

A method for a vehicle, includes: receiving a crankshaft position signal from a bi-directional crankshaft sensor; selectively indicating that a crankshaft of an engine is rotating in a first direction based on the crankshaft position signal; and disabling current to a starter motor when the crankshaft is rotating in the first direction. The engine rotates in a second direction that is opposite to the first direction when the engine is running.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
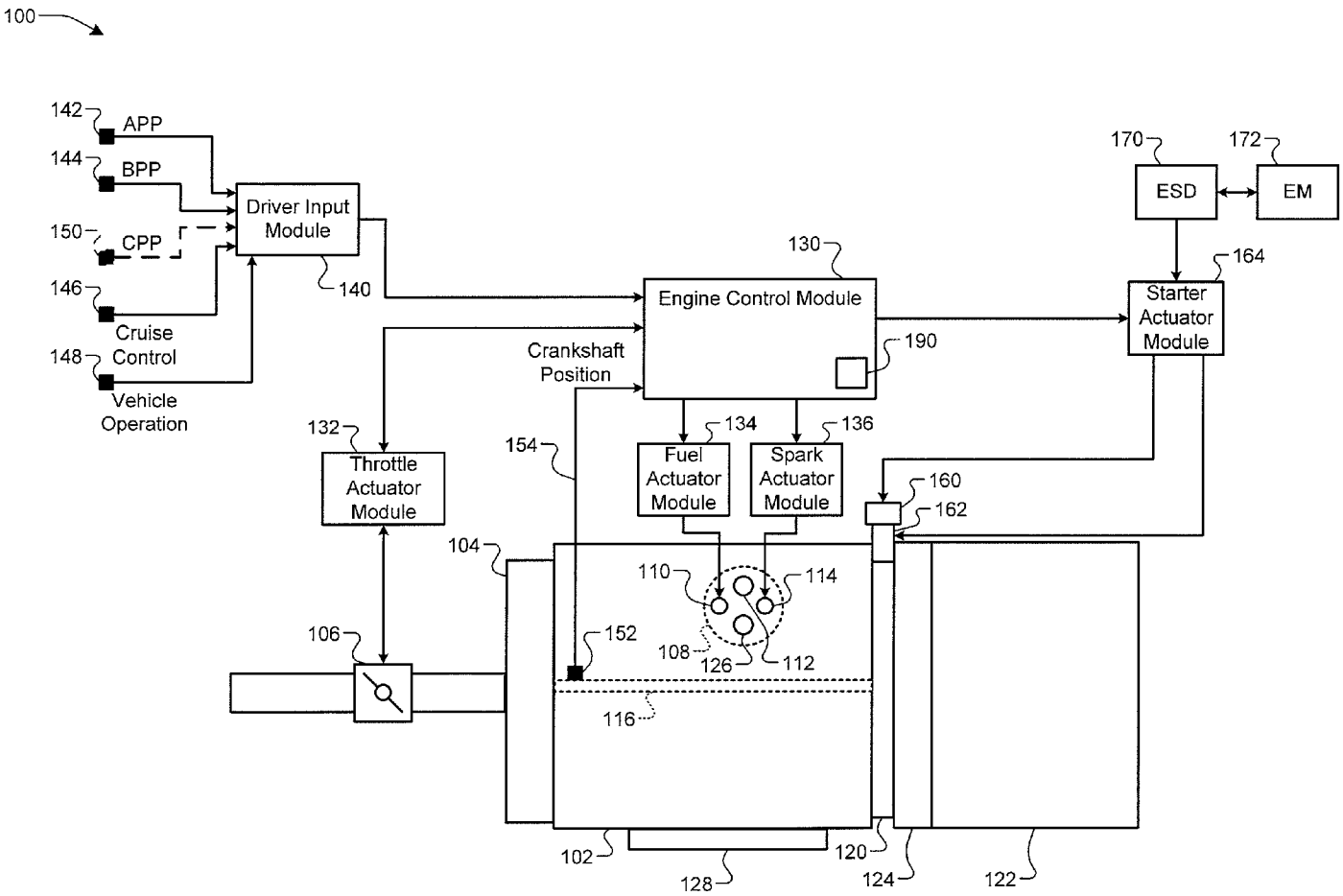
FIG. 1 is a functional block diagram of an example engine system according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

An engine outputs torque to a transmission via a crankshaft. A flywheel is coupled to and rotates with the crankshaft.

A starter is selectively engaged with the flywheel when the engine is shut down to start the engine. The engine may be shut down, for example, when the vehicle is turned off. The ECM may also selectively shut down the engine when the vehicle is still running. For example only, an engine control module (ECM) may shut down the engine and later start the engine while the vehicle is running for an auto-stop/start event.

Under some circumstances, however, the engine may rotate in a backward direction relative to its normal direction of rotation when the engine is off. For example only, gas trapped within the cylinder when the engine is off may urge rotation of the crankshaft in the backward direction while the engine is off. If the starter is engaged and powered, such as may be the case during an auto-stop/start event, the starter may resist the backward rotation of the crankshaft. The ECM of the present disclosure detects the backward rotation of the crankshaft and disables the starter when the crankshaft rotates in the backward direction.

Referring now to FIG. 1, a functional block diagram of an exemplary engine system 100 is presented. The engine system 100 includes an engine 102 that combusts an air/fuel mixture to produce drive torque for a vehicle. Air is drawn into an intake manifold 104 through a throttle valve 106. The throttle valve 106 regulates air flow into the intake manifold 104. Air within the intake manifold 104 is drawn into one or more cylinders of the engine 102, such as cylinder 108.

One or more fuel injectors, such as fuel injector 110, inject fuel that mixes with air to form an air/fuel mixture. In various implementations, one fuel injector may be provided for each cylinder of the engine 102. One or more intake valves, such as intake valve 112, open to allow air into the cylinder 108. A piston (not shown) compresses the air/fuel mixture within the cylinder 108. In some engine systems, a spark plug 114 initiates combustion of the air/fuel mixture within the cylinder 108. In other engine systems, such as diesel engine systems, combustion may be initiated without the spark plug 114.

Combustion of the air/fuel mixture applies force to the piston, which rotatably drives a crankshaft 116. The engine 102 outputs torque via the crankshaft 116. A flywheel 120 is coupled to and rotates with the crankshaft 116. Torque output by the engine 102 is selectively transferred to a transmission 122 via a torque transfer device 124. More specifically, the torque transfer device 124 selectively couples the transmission 122 to the engine 102 and de-couples the transmission 122 from the engine 102. The transmission 122 may include, for example, a manual transmission, an automatic transmission, a semi-automatic transmission, an auto-manual transmission, or another suitable type of transmission. The torque transfer device 124 may include, for example, a torque converter and/or one or more clutches.

Exhaust produced by combustion of the air/fuel mixture is expelled from the cylinder 108 via an exhaust valve 126. The exhaust is expelled from the cylinders to an exhaust system 128. The exhaust system 128 may treat the exhaust before the exhaust is expelled from the exhaust system 128. Although one intake and exhaust valve are shown and described as being associated with the cylinder 108, more than one intake and/or exhaust valve may be associated with each cylinder of the engine 102.

An engine control module (ECM) 130 controls the torque output of the engine 102. For example only, the ECM 130 may control the torque output of the engine 102 via various engine actuators. The engine actuators may include, for example, a throttle actuator module 132, a fuel actuator module 134, and a spark actuator module 136. The engine system 100 may also include other engine actuators, and the ECM 130 may control the other engine actuators.

Each engine actuator controls an operating parameter based on a signal from the ECM 130. For example only, the throttle actuator module 132 may control opening of the throttle valve 106 based on a signal from the ECM 130. The fuel actuator module 134 and the spark actuator module 136 may control fuel injection and spark timing, respectively, based on signals from the ECM 130.

The ECM 130 may control the torque output of the engine 102 based on, for example, driver inputs and inputs from various vehicle systems. The vehicle systems may include, for example, a transmission system, a hybrid control system, a stability control system, a chassis control system, and other suitable vehicle systems.

A driver input module 140 provides the driver inputs to the ECM 130. The driver inputs may include, for example, an accelerator pedal position (APP), a brake pedal position (BPP), cruise control inputs, and vehicle operation commands. An APP sensor 142 measures position of an accelerator pedal (not shown) and generates the APP based on the position. A BPP sensor 144 monitors actuation of a brake pedal (not shown) and generates the BPP accordingly. A cruise control system 146 provides the cruise control inputs, such as a desired vehicle speed, based on inputs to the cruise control system 146. The vehicle operation commands may include, for example, vehicle startup commands and vehicle shutdown commands. The vehicle operation commands may be made via actuation of, for example, an ignition key, one or more buttons/switches, and/or one or more suitable vehicle operation inputs 148.

In vehicles having a manual transmission, the driver inputs provided to the ECM 130 may also include a clutch pedal position (CPP). A CPP sensor 150 monitors actuation of a clutch pedal (not shown) and generates the CPP accordingly. The clutch pedal may be actuated to couple the transmission 122 to the engine 102 and de-couple the transmission 122 from the engine 102.

In some implementations, the BPP sensor 144 and the CPP sensor 150 may measure the position of the associated pedal and generate the BPP and the CPP, respectively, based on the measured position of the associated pedal. In other implementations, the BPP sensor 144 and the CPP sensor 150 may each include one or more switches and may generate the BPP and the CPP, respectively, indicating whether the associated pedal is depressed relative to predetermined resting positions. While the APP sensor 142, the BPP sensor 144, and the CPP sensor 150 are shown and described, one or more additional APP, BPP, and/or CPP sensors may be provided.

The ECM 130 may selectively make control decisions for the engine system 100 based on one or more measured operating parameters. For example only, a crankshaft position sensor 152 monitors rotation of the crankshaft 116 and generates a crankshaft position signal 154 based on the rotation of the crankshaft 116. For example only, the crankshaft position sensor 152 may include a variable reluctance (VR) sensor or another suitable type of crankshaft position sensor. The crankshaft position signal 154 may include a pulse train. Each pulse of the pulse train may be generated as a tooth of an N-toothed wheel that rotates with the crankshaft 116 passes the crankshaft position sensor 152. Accordingly, each pulse corresponds to an angular rotation of the crankshaft 116 by approximately 360° divided by N teeth. The N-toothed wheel may also include a gap of one or more missing teeth, and the gap may be used as an indicator of one complete revolution of the crankshaft 116 (i.e., 360° of crankshaft rotation). In various implementations, the N-toothed wheel may be the flywheel 120 or another suitable N-toothed wheel.

The crankshaft position sensor 152 is a bi-directional sensor. The crankshaft position sensor 152 may generate a first predetermined type of pulse in the crankshaft position signal 154 each time that a tooth of the N-toothed wheel passes the crankshaft position sensor 152 in a first rotational direction. The crankshaft position sensor 152 may generate a second predetermined type of pulse in the crankshaft position signal 154 each time that a tooth of the N-toothed wheel passes the crankshaft position sensor 152 in a second rotational direction. The first and second rotational directions are opposite each other, and the first predetermined type of pulse is different than the second predetermined type of pulse. One of the first and second directions includes the normal rotational direction of the crankshaft 116 during operation of the engine 102, and the other of the first and second directions is the opposite direction. The ECM 130 may also receive operating parameters measured by other sensors, such as oxygen in the exhaust, engine coolant temperature, intake air temperature, mass air flowrate, oil temperature, manifold absolute pressure, and/or other suitable operating parameters.

The ECM 130 selectively shuts down the engine 102 when a vehicle shutdown command is received. For example only, the ECM 130 may disable the injection of fuel, disable the provision of spark, and perform other engine shutdown operations to shut down the engine 102. A starter motor 160 may be engaged with the engine 102 while the engine 102 is off for an engine startup event. For example only, the starter motor 160 may be engaged with the engine 102 when a vehicle startup command is received. The starter motor 160 may engage the flywheel 120 or other suitable component(s) that drive rotation of the crankshaft 116.

A starter motor actuator 162, such as a solenoid, selectively engages the starter motor 160 with the engine 102. For example only, the starter motor actuator 162 may selectively engage a starter pinion (not shown) with the flywheel 120. The starter pinion is coupled to the starter motor 160 via a driveshaft and a one-way clutch (not shown). A starter actuator module 164 controls the starter motor actuator 162 and the starter motor 160 based on signals from the ECM 130.

The starter actuator module 164 selectively applies current to the starter motor 160 when the starter motor 160 is engaged with the engine 102 to start the engine 102. For example only, the starter actuator module 164 may include a starter relay. The application of current to the starter motor 160 drives rotation of the starter motor 160, and the starter motor 160 drives rotation of the crankshaft 116 (via the flywheel 120). Driving the crankshaft 116 to start the engine 102 may be referred to as engine cranking.

The current provided to the starter motor 160 may be provided by, for example, an energy storage device (ESD) 170. For example only, the ESD 170 may include one or more batteries. The engine system 100 may include one or more electric motors, such as electric motor (EM) 172. The EM 172 may selectively draw electrical power from the ESD 170, for example, to supplement the torque output of the engine 102. The EM 172 may also selectively function as a generator and selectively apply a braking torque to generate electrical power. Generated electrical power may be used to, for example, charge the ESD 170, provide electrical power to one or more other EMs (not shown), provide electrical power to other vehicle systems, and/or other suitable uses.

Once the engine 102 is deemed running after the engine startup event, the starter motor 160 may be disengaged from the engine 102, and the flow of current to the starter motor 160 may be discontinued. The engine 102 may be deemed running, for example, when engine speed exceeds a predetermined speed, such as a predetermined idle speed. For example only, the predetermined idle speed may be approximately 700 rpm. Engine cranking may be said to be completed when the engine 102 is deemed running.

Other than commanded vehicle startups and vehicle shutdowns, the ECM 130 may selectively initiate auto-stop events and auto-start events of the engine 102. An auto-stop event includes shutting down the engine 102 when one or more predetermined enabling criteria are satisfied when vehicle shutdown has not been commanded (e.g., while the ignition key is in an on position). During an auto-stop event, the engine 102 may be shut down and the provision of fuel to the engine 102 may be disabled, for example, to increase fuel economy (by decreasing fuel consumption).

While the engine 102 is shut down during an auto-stop event, the ECM 130 may selectively initiate an auto-start event. An auto-start event may include, for example, enabling fueling, enabling the provision of spark, engaging the starter motor 160 with the engine 102, and applying current to the starter motor 160 to start the engine 102.

The one-way clutch associated with the starter motor 160 allows the starter motor 160 to transfer (positive) torque to the flywheel 120 but not vice versa. More specifically, when the starter motor 160 is engaged, the one-way clutch couples the starter motor 160 and the flywheel 120 when the starter motor speed is greater than the flywheel speed. The one-way clutch de-couples the starter motor 160 and the engine 102 when the flywheel speed is greater than the starter motor speed. In this manner, the one-way clutch prevents the starter motor 160 from being overrun.

Under some circumstances, such as when the engine 102 is shut down for an auto-stop event, the crankshaft 116 may rotate backward relative to a normal direction of rotation when the engine 102 is on. For example only, the gas trapped within one or more cylinders of the engine 102 may apply a force on the crankshaft 116 in the backward direction when the engine 102 is shut down for an auto-stop event. Rotation of the crankshaft 116 in the backward direction while the engine 102 is off may be referred to as engine rockback.

When current is applied to the starter motor 160, the starter motor torque is positive or zero. During engine rockback, the flywheel torque is negative. Accordingly, if the starter motor 160 is engaged with the engine 102 and current is applied to the starter motor 160 during engine rockback, the one-way clutch is engaged. The flywheel 120 will therefore be driving the starter motor 160 in a backward direction relative to its normal direction of rotation. Engine rockback may not occur in some circumstances and may occur for up to a maximum period, such as 300 milliseconds (ms) under some circumstances.

The ECM 130 of the present disclosure includes a starter control module 190. The starter control module 190 controls the engagement of the starter motor 160 with the engine 102 and controls the application of current to the starter motor 160. The starter control module 190 indicates whether engine rockback is occurring based on the crankshaft position signal 154. When engine rockback is occurring, the starter control module 190 disables (the current to) the starter motor 160.

Figure 2:
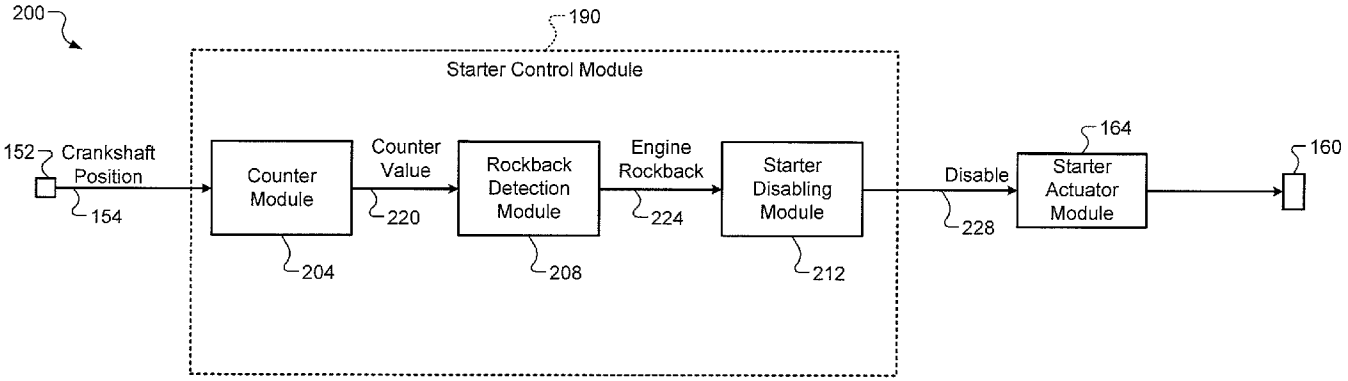
FIGS. 2 and 3 are functional block diagrams of example starter control systems according to the present disclosure.

Referring now to FIG. 2, a functional block diagram of an example starter control system 200 is presented. The starter control module 190 may include a counter module 204, a rockback detection module 208, and a starter disabling module 212.

The counter module 204 monitors the crankshaft position signal 154 generated by the crankshaft position sensor 152. As stated above, the crankshaft position sensor 152 generates pulses in the crankshaft position signal 154 as the teeth of the N-toothed wheel pass the crankshaft position sensor 152. The crankshaft position sensor 152 generates the first predetermined type of pulse and the second predetermined type of pulse in the crankshaft position signal 154 each time that a tooth passes the crankshaft position sensor 152 in the first direction and the second direction, respectively.

The counter module 204 increments or decrements a counter value 220 for each pulse in the crankshaft position signal 154. For example only, the counter module 204 may increment the counter value 220 by a predetermined value each time that the first predetermined type of pulse is generated in the crankshaft position signal 154. The counter module 204 may decrement the counter value 220 by the predetermined value each time that the second predetermined pulse is generated in the crankshaft position signal 154.

The rockback detection module 208 selectively indicates that engine rockback is occurring based on the counter value 220. For example only, the rockback detection module 208 may indicate that engine rockback is occurring when the counter value 220 decreases. The rockback detection module 208 generates an engine rockback indicator (e.g., a signal, flag, etc) 224 that indicates whether engine rockback is occurring. For example only, the rockback detection module 208 may set the engine rockback indicator 224 to an active state when engine rockback is occurring and set the engine rockback indicator 224 to an inactive state when engine rockback is not occurring. The rockback detection module 208 may set the engine rockback indicator 224 to the inactive state when the counter value 220 is constant for a predetermined period (e.g., a control loop) and/or the counter value 220 increases.

The starter disabling module 212 selectively disables the starter motor 160 based on the engine rockback indicator 224. More specifically, the starter disabling module 212 selectively disables the flow of current to the starter motor 160 based on the engine rockback indicator 224. The starter disabling module 212 disables the starter motor 160 when the engine rockback indicator 224 indicates that engine rockback is occurring. For example only, the starter disabling module 212 may generate a disable signal 228 and output the disable signal 228 to the starter actuator module 164. The starter actuator module 164 may disable the flow of current to the starter motor 160 when the disable signal 228 is received. The starter actuator module 164 may additionally disengage the starter motor 160 from the engine 102 when the disable signal 228 is received in various implementations.

Figure 3:
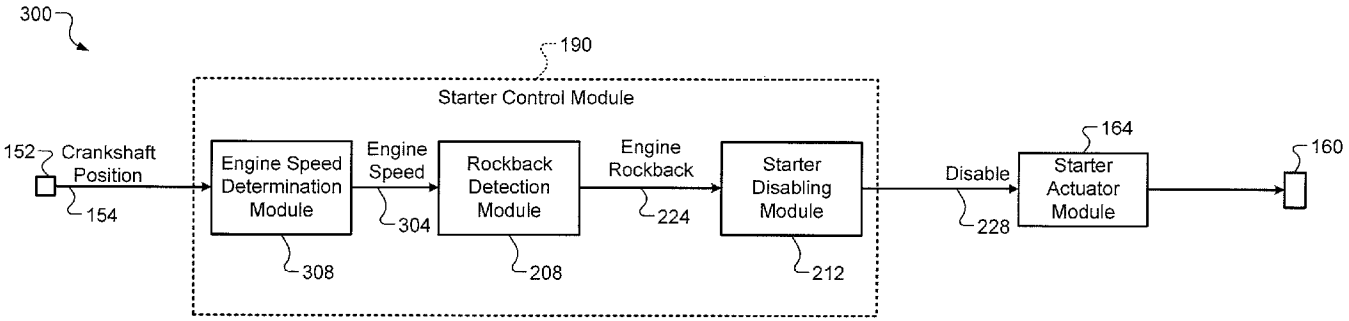

Referring now to FIG. 3, a functional block diagram of another example starter control system 300 is presented. In various implementations, the rockback detection module 208 may generate the engine rockback indicator 224 based on an engine speed 304. The engine speed 304 indicates the rotational speed of the crankshaft 116 and the direction of rotation of the crankshaft 116.

For example only, the rockback detection module 208 may set the engine rockback indicator 224 to the active state when the engine speed 304 is less than zero (i.e., negative). The rockback detection module 208 may set the engine rockback indicator 224 to the inactive state when the engine speed 304 is zero for a predetermined period (e.g., a control loop) and/or the engine speed 304 is greater than zero.

An engine speed determination module 308 may generate the engine speed 304 based on the crankshaft position signal 154 generated by the crankshaft position sensor 152. For example only, the engine speed determination module 308 may generate the engine speed 304 based on the period between two (e.g., consecutive) pulses in the crankshaft position signal 154 and the types of the pulses. The period between the pulses may be used to determine the speed and the types of the pulses may be used to determine whether the engine speed 304 is positive or negative. For example only, if the pulses are both the first predetermined type of pulse, the engine speed 304 may be positive. If one or both of the pulses are the second predetermined type of pulse, the engine speed 304 may be negative. The engine speed determination module 308 may also generate the engine speed 304 using one or more other parameters, such as a learned distance between the teeth of the N-toothed wheel. The engine speed determination module 308 may also apply one or more filters before outputting the engine speed 304.

Figure 4:
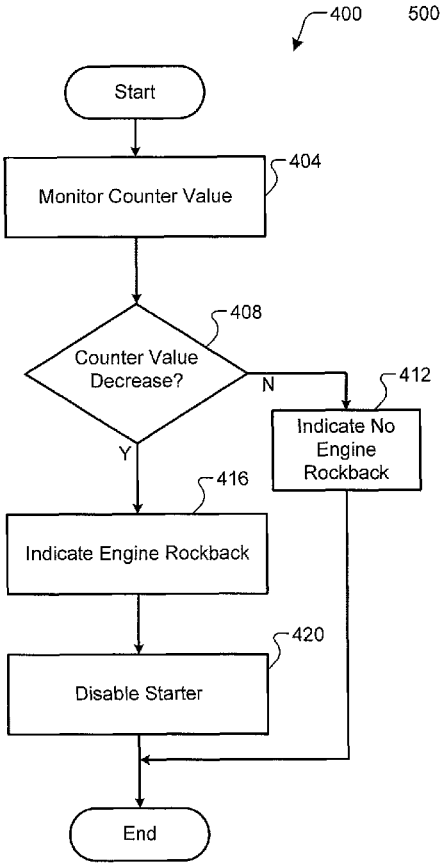
FIGS. 4 and 5 are flowcharts of example methods of controlling a starter according to the present disclosure.

Referring now to FIG. 4, a flowchart depicting an example method 400 of controlling the starter motor 160 is presented. Control begins with 404 where control monitors the counter value 220. The counter value 220 is selectively incremented and decremented based on the pulses in the crankshaft position signal 154. Control determines whether the counter value 220 decreased at 408. If false, control indicates that engine rockback is not occurring at 412, and control may end. If true, control may continue with 416. When engine rockback is not occurring, control may supply current to the starter motor 160 as desired for the operating conditions.

At 416, control indicates that engine rockback is occurring. Control continues with 420. Control disables the starter motor 160 at 420. More specifically, control disables the flow of current to the starter motor 160 at 420. Disabling the current to the starter motor 160 prevents the starter motor 160 from opposing the rotation of the crankshaft 116 in the backward direction, thereby reducing or minimizing stress that may be imposed on the starter motor 160 and/or the one-way clutch during engine rockback. Control may also remove power to the starter motor actuator 162 (to disengage the starter motor 160 from the engine 102) at 420.

Figure 5:
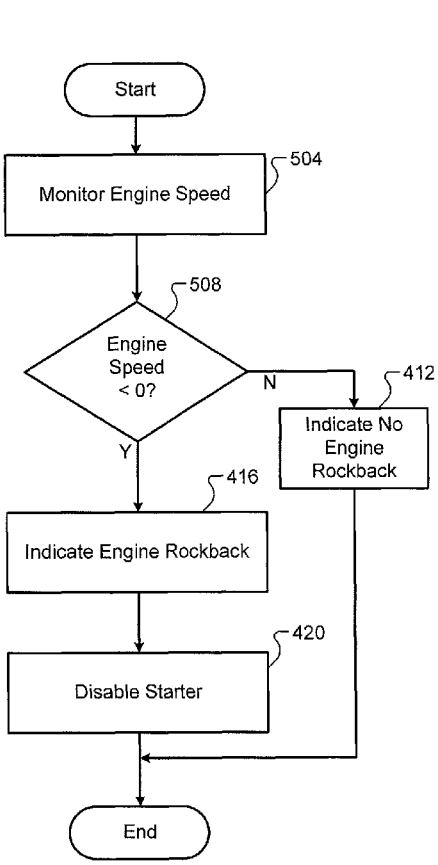

Referring now to FIG. 5, another flowchart depicting an example method 500 of controlling the starter motor 160 is presented. At 504, control may monitor the engine speed 304. The engine speed 304 indicates the rotational speed and direction of rotation of the crankshaft 116. For example only, the engine speed 304 is positive when the crankshaft 116 is rotating in the normal direction and negative when the crankshaft 116 is rotating in the backward direction.

At 508, control determines whether the engine speed 304 is less than zero (i.e., negative). If true, control indicates that engine rockback is occurring at 416 and disables the starter motor 160 at 420. If false, control indicates that engine rockback is not occurring at 412. When engine rockback is not occurring, control may supply current to the starter motor 160 as desired for the operating conditions.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for a vehicle, comprising:

a rockback detection module that receives a crankshaft position signal from a bi-directional crankshaft sensor and that selectively indicates that a crankshaft of an engine is rotating in a first direction based on the crankshaft position signal, wherein the engine rotates in a second direction that is opposite to the first direction when the engine is running; and a starter disabling module that disables current to a starter motor when the crankshaft is rotating in the first direction and that disengages the starter motor from the engine when the crankshaft is rotating in the first direction.

2. The system of claim 1 further comprising a counter module that selectively increments and decrements a counter value based on pulses in the crankshaft position signal, wherein the rockback detection module selectively indicates that the crankshaft is rotating in the first direction based on a change in the counter value.

3. The system of claim 2 wherein the counter module increments the counter value when a first predetermined type of pulse is generated in the crankshaft position signal and decrements the counter value when a second predetermined type of pulse is generated in the crankshaft position signal, wherein the first and second predetermined types of pulses are different, and wherein the rockback detection module indicates that the crankshaft is rotating in the first direction when the counter value decreases.

4. The system of claim 2 wherein the rockback detection module selectively indicates that the crankshaft is not rotating in the first direction when at least one of the counter value is constant for a predetermined period and the counter value increases.

5. The system of claim 4 wherein the starter disabling module enables application of current to the starter motor when the crankshaft is not rotating in the first direction.

6. The system of claim 1 further comprising an engine speed determination module that generates an engine speed based on pulses in the crankshaft position signal, wherein the rockback detection module selectively indicates that the crankshaft is rotating in the first direction based on the engine speed.

7. The system of claim 6 wherein the rockback detection module indicates that the crankshaft is rotating in the first direction when the engine speed is less than zero.

8. The system of claim 6 wherein the engine speed determination module generates the engine speed based on a period between two pulses in the crankshaft position signal, a rotational distance between teeth corresponding to the two pulses, and shapes of the two pulses.

9. The system of claim 6 wherein the rockback detection module selectively indicates that the crankshaft is not rotating in the first direction when the engine speed is one of zero and positive.

10. The system of claim 9 wherein the starter disabling module enables application of current to the starter motor when the crankshaft is not rotating in the first direction.

11. The system of claim 1 further comprising a one-way clutch that, when the starter motor is engaged with the engine, couples the starter motor with the engine when a speed of the starter motor is greater than an engine speed and that decouples the starter motor from the engine when the engine speed is greater than the speed of the starter motor.

12. A method for a vehicle, comprising:

receiving a crankshaft position signal from a bi-directional crankshaft sensor;

selectively indicating that a crankshaft of an engine is rotating in a first direction based on the crankshaft position signal, wherein the engine rotates in a second direction that is opposite to the first direction when the engine is running;

disabling current to a starter motor when the crankshaft is rotating in the first direction; and disengaging the starter motor from the engine when the crankshaft is rotating in the first direction.

13. The method of claim 12 further comprising:

selectively incrementing and decrementing a counter value based on pulses in the crankshaft position signal; and selectively indicating that the crankshaft is rotating in the first direction based on a change in the counter value.

14. The method of claim 13 further comprising:

incrementing the counter value when a first predetermined type of pulse is generated in the crankshaft position signal;

decrementing the counter value when a second predetermined type of pulse is generated in the crankshaft position signal, wherein the first and second predetermined types of pulses are different; and indicating that the crankshaft is rotating in the first direction when the counter value decreases.

15. The method of claim 13 further comprising selectively indicating that the crankshaft is not rotating in the first direction when at least one of the counter value is constant for a predetermined period and the counter value increases.

16. The method of claim 15 further comprising enabling application of current to the starter motor when the crankshaft is not rotating in the first direction.

17. The method of claim 12 further comprising:

generating an engine speed based on pulses in the crankshaft position signal; and selectively indicating that the crankshaft is rotating in the first direction based on the engine speed.

18. The method of claim 17 further comprising indicating that the crankshaft is rotating in the first direction when the engine speed is less than zero.

19. The method of claim 17 further comprising generating the engine speed based on a period between two pulses in the crankshaft position signal, a rotational distance between teeth corresponding to the two pulses, and shapes of the two pulses.

20. The method of claim 17 further comprising selectively indicating that the crankshaft is not rotating in the first direction when the engine speed is one of zero and positive.

21. The method of claim 20 further comprising enabling application of current to the starter motor when the crankshaft is not rotating in the first direction.

* * * * *